US005798782A

United States Patent [19]

Rodi

[11] Patent Number: 5,798,782

[45] Date of Patent: Aug. 25, 1998

[54] PRINTING OR WRITING DEVICE FOR CONTROLLED APPLICATION OF CHARGE CARRIERS TO A SUBSTRATE

[75] Inventor: Anton Rodi, Leimen, Germany

[73] Assignee: Heidelberger Druckmaschinen AG, Heidelberg, Germany

[21] Appl. No.: 422,454

[22] Filed: Apr. 17, 1995

[30] Foreign Application Priority Data

Apr. 15, 1994 [DE] Germany ..... 44 13 237.9

[51] Int. Cl.[6] ..... B41J 2/415

[52] U.S. Cl. ..... 347/123; 347/128

[58] Field of Search ..... 347/123, 128, 347/141, 142, 143, 144, 145, 124, 125, 126, 127; 361/229, 230; 399/168, 170

[56] References Cited

U.S. PATENT DOCUMENTS 4,763,141 8/1988 Gundlach et al. .

5,296,878 3/1994 Hosaka et al. ..... 347/127

FOREIGN PATENT DOCUMENTS 61-255870 11/1986 Japan .

*Primary Examiner*—Joan H. Pendegrass

*Attorney, Agent, or Firm*—Herbert L. Lerner; Laurence A. Greenberg

[57] ABSTRACT

Marking device for controlled application of charge carriers to a substrate includes a charge carrier source for generating the charge carriers, a voltage source having a first pole and a second pole connected to the charge carrier source and forming therewith a current circuit wherein a control device is located, the voltage source having a third pole for generating a predeterminable electrical potential on the substrate, so that the charge carriers are applicable thereat by corresponding triggering of the control device, the control device being assigned to at least one of the first and the second poles and being located at approximately 0-volt potential.

17 Claims, 2 Drawing Sheets

PRINTING OR WRITING DEVICE FOR CONTROLLED APPLICATION OF CHARGE CARRIERS TO A SUBSTRATE

BACKGROUND OF THE INVENTION

Field of the Invention

The invention relates to a printing or writing device, referred to in general herein as a marking device, for controlled application of charge carriers to a substrate, including a charge carrier source for generating the charge carriers, a voltage source having a first pole and a second pole connected to the charge carrier source and forming therewith a current circuit wherein a control device is located, the voltage source having a third pole for generating a predeterminable electrical potential on the substrate, so that the charge carriers are applicable thereat by corresponding triggering of the control device.

Writing or printing or marking devices of the type referred to at the introduction hereto have become known heretofore. They serve to enable the application of charge carriers to a substrate in a defined manner, for example, in order to bind or bond to these applied charge carriers an ink or color medium or pigment which is then transferred or applied to printing material or stock, such as paper or the like. To attain the highest-quality writing or printing result possible, it is necessary for the ink medium or the like to be transferred to the material to be printed with a very high resolution per unit of surface area. The largest possible scale of integration of the various components of the printing device is thus necessary, but this runs up against limits in terms of the insulation spacings. Moreover, the printing or writing device, which has electronic components and especially semiconductors, is always exposed to the danger that high potential differences can result in undesired disruptive breakdowns, which can cause the device to become non-functional.

SUMMARY OF THE INVENTION

It is accordingly an object of the invention to provide a printing or writing or marking device of the type referred to at the introduction hereto which permits a maximum possible integration and has high functional reliability.

With the foregoing and other objects in view, there is provided, in accordance with the invention, a marking device for controlled application of charge carriers to a substrate, comprising a charge carrier source for generating the charge carriers, a voltage source having a first pole and a second pole connected to the charge carrier source and forming therewith a current circuit wherein a control device is located, the voltage source having a third pole for generating a predeterminable electrical potential on the substrate, so that the charge carriers are applicable thereat by corresponding triggering of the control device, the control device being assigned to at least one of the first and the second poles and being located at approximately 0-volt potential.

In accordance with another feature of the invention, the charge carrier source is an ion source.

In accordance with a further feature of the invention, the first pole forms an anode.

In accordance with an added feature of the invention, the second pole forms a cathode.

In accordance with an additional feature of the invention, the third pole has a potential which is positive compared with the cathode potential.

In accordance with yet another feature of the invention, the control device is located between the cathode and the approximately 0-volt potential.

In accordance with yet a further feature of the invention, the anode has a potential of >+200 V.

In accordance with yet an added feature of the invention, the cathode has a potential of approximately 0 V.

In accordance with yet an additional feature of the invention, the third pole has a potential of >+40 V.

In accordance with a concomitant feature of the invention, the anode has a voltage U bringable to a voltage $U_{max}$ for igniting the charge carrier source, the voltage $U_{max}$ being greater than a voltage $U_{peak}$ at the anode, the anode having a standby or static state mode at an assumed voltage $U_{stat}$ which is lower than the voltage $U_{peak}$.

The object of the invention is thus attained by providing that the control device be assigned to at least one of the first and the second poles and is located at approximately 0-volt potential (0-V potential). Due to this construction, the components of the electronic control device thus have potentials which are in the range of the 0-volt potential, or in other words have approximately the same potential, typically called the ground potential, of the environment. The word "approximately" expresses the fact that the statement "0-volt potential" cannot mean that there is no longer any voltage rise available for the control function, but rather is an indication that the various components and elements of the control device are in the range of this 0-volt potential, for instance in the range of 30 V, if this kind of control voltage is employed. Overall, because of the construction according to the invention, assured is provided that the individual component groups of the control device are subject to only a slight voltage difference compared with the surrounding ground potential, so that very small spacings suffice nevertheless to assure adequate voltage strength. The highest possible scale or level of integration is thus possible without having to fear breakdowns or sparkovers. Because of the construction according to the invention, not only the component groups used directly to control the charge carriers, but also elements such as microprocessors, which precede them and with which the triggering of the marking, writing or printing device is performed, can be within the region of the 0-volt potential; they are thus subject to the advantages mentioned hereinbefore. Because of the high scale or level of integration enabled by the invention, the small spacings mean that very short switching times are possible; in other words, an essentially delay-free triggering can be accomplished.

By the charge carrier source being an ion source, the advantage is offered that the charge carriers used for the marking or the like are ions which have a considerably lower mobility, when compared with electrons, and therefore remain firmly on the substrate at the location where they were deposited.

It is also advantageous if the first pole forms an anode. In particular, the second pole forms a cathode. The third pole is preferably provided with a positive potential, but this positive potential is substantially less than the positive potential of the anode.

It is especially preferable if the control device is located between the cathode and the approximately 0-volt potential.

In a further feature of the invention, it is advantageous if the anode has a potential of >+200 V. By comparison, the cathode has a potential of approximately 0 V; that is, it is located at the electrical potential of the control device. Thus the control device is associated with the cathode. The third pole, which is connected to the substrate, preferably has a potential of >40 V.

The invention also relates to a marking, printing or writing device for the controlled application of charge carriers to a substrate, wherein a charge carrier source for generating the charge carriers and a control device are present, wherein the anode voltage U for igniting the charge carrier course is brought to a voltage $U_{max}$, which is greater than a voltage $U_{peak}$ at the anode. The charge carrier source, which has a plasma path, is ignited in this manner. The anode has an assumed voltage $U_{stat}$ for a standby or static state mode thereof, which is lower than the voltage $U_{peak}$.

Other features which are considered as characteristic for the invention are set forth in the appended claims.

Although the invention is illustrated and described herein as embodied in a printing device for controlled application of charge carriers to a substrate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
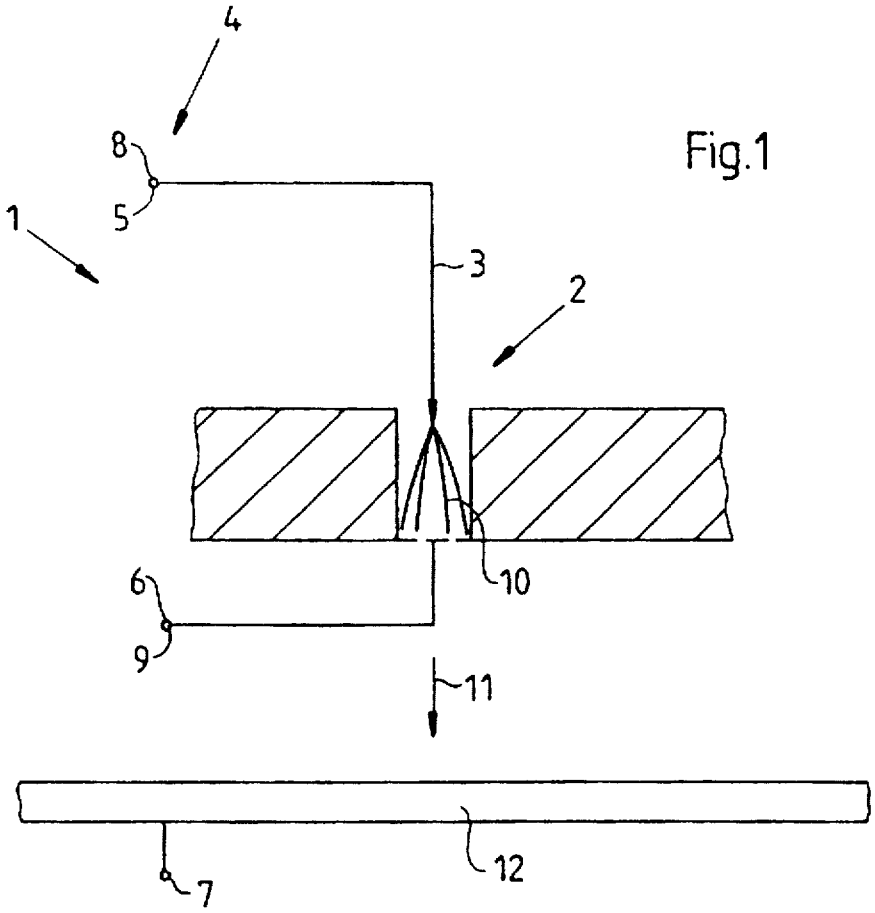
FIG. 1 is a schematic and diagrammatic view of the printing or writing device according to the invention.

FIG. 1 shows a printing or writing device 1 having a charge carrier source 2, which is connected via a current circuit 3 to an otherwise non-illustrated conventional voltage source 4, which has a first pole 5, a second pole 6 and a third pole 7. The first pole 5 forms an anode 8, and the second pole 6 forms a cathode 9.

The arrangement is selected so that if an ignition voltage located between the anode 8 and the cathode 9 is exceeded, a plasma path 10 in the charge carrier source 2 is ignited, thereby producing free charge carriers, namely ions. In a static or standby mode, a resting current develops in the current circuit 3, which maintains the flow of plasma current. By means of a control device which is not shown in FIG. 1, the flow conditions can be shifted, so that ions leave the current circuit 3 in the direction of the arrow 11 and strike a substrate 12, as a result of which a targeted writing or printing onto the substrate with ions is possible. Preferably, a plurality of charge carrier sources 2 are provided which, spaced closely together or, in other words, having a very large scale of integration, face the substrate 2 and are respectively able, when triggered, to deposit ions onto the surface of the substrate 12. The substrate 12 is constructed as a dielectric element, which is provided with a conductive layer forming the pole 7. In this manner, by suitable triggering, a charge image can be produced on the surface of the substrate 12, which then comes into contact with an ink medium or the like, in a further method step, not shown in FIG. 1, as a result of which the ink medium or the like is correspondingly bound or bonded to the subject or motif to be printed and then transferred to printing material or stock, such as paper.

In a preferred exemplary embodiment of the invention, the anode 8 has a potential of >+200 V, in particular >+300 V. The cathode 9 according to the invention has a potential which is in the 0-volt potential range and above. The potential of the substrate 12, which is applied by the voltage source 4 via the third pole 7, is preferably >40 V and in particular is approximately 60 V.

Figure 2:
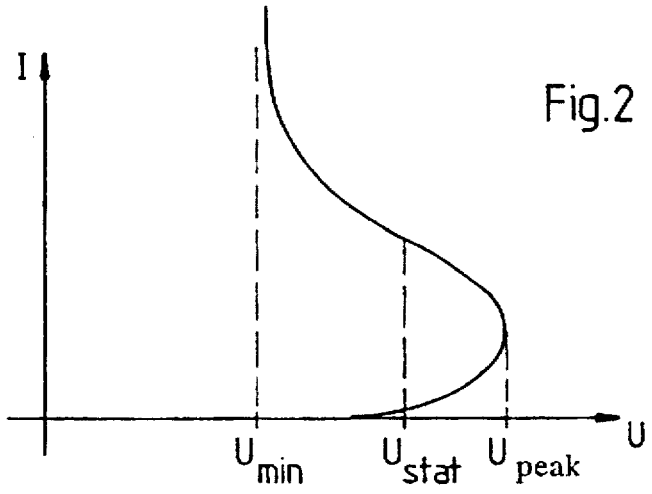
FIG. 2 is a current/voltage plot diagram of a charge carrier source of the printing or writing device of FIG. 1.

FIG. 2, solely in the interest of clarity, shows a current/voltage plot diagram of the plasma path 10 of the charge carrier source 2. It is believed to be readily apparent that if the voltage U rises, the plasma path ignites, and the current then drops considerably, with a reduction of the requisite resting voltage in order to maintain the plasma current flow, even slight changes in voltage causing very major changes in current. The operation of the printing or writing device according to the invention thus first requires igniting the individual plasma paths 10. Not until then, can voltage discontinuities be generated by means of the associated control devices in the current circuit 3, thereby causing ions to deposit on the substrate 12.

Figure 3:
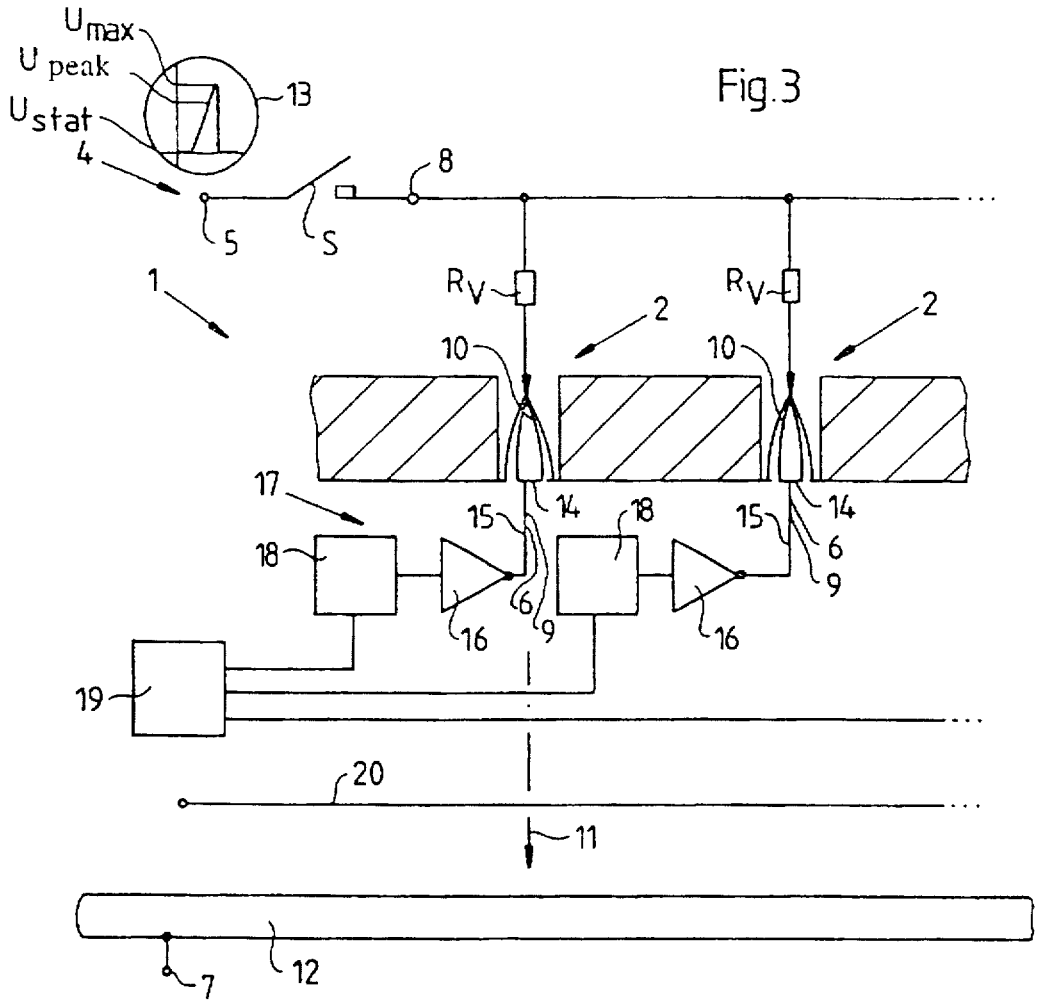
FIG. 3 is a basic circuit diagram of the printing or writing device according to the invention.

FIG. 3 is a block circuit diagram for the printing or writing device 1 according to the invention. It is apparent therefrom that a voltage pulse 13 is applied to the anode 8 and serves to ignite all the plasma paths 10. Once the ignition has taken place, the charge carrier sources 2 are in the aforementioned static or standby mode. The voltage conditions are selected so that no ions strike the substrate 12. If the voltage pulse 13 is compared with what FIG. 2 shows, it becomes clear that ignition of the plasma paths 10 requires first applying the voltage $U_{max}$, which is higher than the voltage $U_{peak}$ of FIG. 2, to the anode 8. Once the ignition has occurred, operation is in the static or standby mode, which requires a voltage $U_{stat}$ lower than the voltage $U_{peak}$. The voltage $U_{stat}$, as FIG. 2 shows, is higher than the anode voltage $U_{min}$ (FIG. 2) which runs approximately parallel to the I axis. The overall result of these voltage conditions is the advantage that only low voltage drops occur in the control path of the control device 17, and this is important if a very large scale or high level of integration for the circuit is to be attained.

A switch S serves as an on-off switch; that is, for operating the device according to the invention, the switch S is closed. Optionally, in the region of the anode 8, each charge carrier source 2 is advantageously assigned a protective resistor $R_v$, which serves to calibrate the various plasma paths 10 approximately identically to one another.

Figure 4:
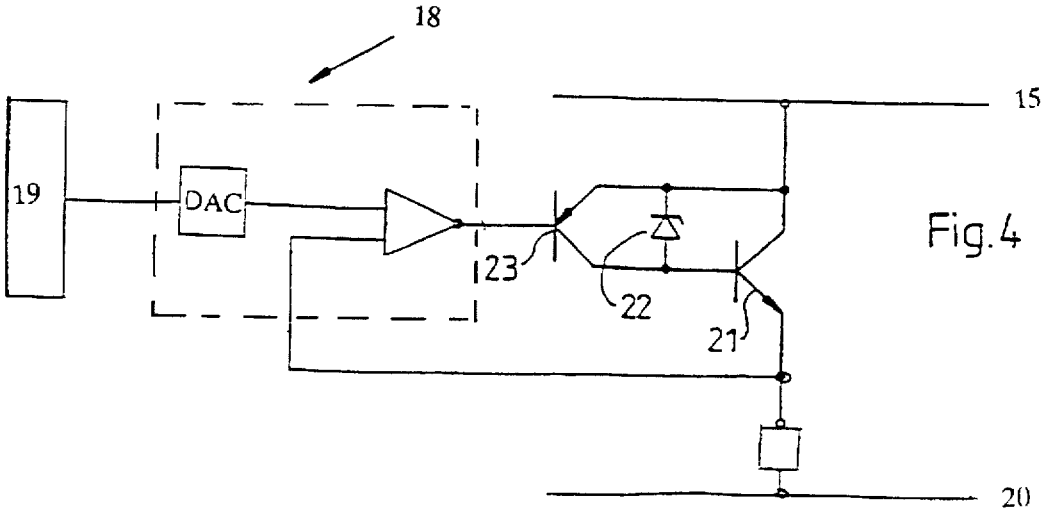
FIG. 4 is a self-protection device of the circuit of FIG. 3.

The resting current is thus adjusted to be constant overall. An electric lead 15, which leads to an end stage 16 of the control device 17 mentioned hereinbefore is connected to a terminal 14, forming the opposite pole to the anode, of the plasma path 10 which represents the cathode 9, the control device 17 also having a logic system 18 and a microprocessor 19. The control device 17, as shown in FIG. 4 particularly, has a ground line 20 which forms the reference potential of the electronics; that is, with respect to the voltage source 4, it is at approximately 0-volt potential. A non-illustrated electronic control element, in particular a transistor or the like, is connected between the lead 15, i.e. the cathode 9, and the ground line 20, the potential of the lead 15 and hence the cathode 9 being variable thereby, and in particular being "pullable downwardly" as far as the potential of the ground line 20. This control element may also be a controllable or variable resistor or the like. This possible varying or optional embodiment represents the control option for the control device 17. By suitable variation of the potential, it is possible, as explained hereinbefore in connection with FIG. 1, for ions to be actively transferred to the substrate 12 in the direction of the arrow 11.

It is believed to be clear from the foregoing description that the control device and hence the attendant advantages, and in particular the electronic components of the logic unit 18 and of the microprocessor 19, are located in a potential range which is equivalent to ground potential, so that the prevailing voltages are relatively low by comparison with ground voltage, namely are in the range of control voltages. In this manner, sparkovers and breakdowns can be avoided, and an optimally highest level of integration of the components can be attained. Minimum distances are possible, and extremely short switching times can be attained as a result.

FIG. 4 shows a detail of the circuit which has a switching transistor 21 located between the lead 15 and the ground line 20 and which can thus execute the control function. Its base communicates with a Zener diode 22, which leads to the collector of a switching transistor 21. Parallel to the Zener diode 22 is a collector-to-emitter path of a further transistor 23, which serves as a driver. If an overly high voltage were to be delivered to the collector of the switching transistor 21, as a result of an impermissible operating state, the driver transistor 23 enters the breakdown state and correspondingly triggers the switching transistor 21, so that the overall result is self-protection for the electronics. Further shown in FIG. 4 is the composition of the logic unit 18 and its connection from the microprocessor 19 to the electric line 15 and the ground line 20.

I claim:

1. Marking device for controlled application of charge carriers to a substrate, comprising:

a charge carrier source for generating the charge carriers, a voltage source having a first pole and a second pole connected to said charge carrier source and forming therewith a current circuit wherein a control device is located, said voltage source having a third pole for generating a predeterminable electrical potential on the substrate, so that the charge carriers are applicable thereat by corresponding triggering of said control device, said third pole having a potential of >+40 V, and said control device being assigned to at least one of said first and said second poles and being located at approximately 0-volt potential.

2. Marking device according to claim 1, wherein said charge carrier source is an ion source.

3. Marking device according to claim 1, wherein said first pole forms an anode.

4. Marking device according to claim 3, wherein said anode has a potential of >+200 V.

5. Marking device according to claim 1, wherein said second pole forms a cathode.

6. Marking device according to claim 5, wherein said cathode has a potential of approximately 0 V.

7. Marking device for controlled application of charge carriers to a substrate, comprising:

a charge carrier source for generating the charge carriers, a voltage source having a first pole and a second pole connected to said charge carrier source and forming therewith a current circuit wherein a control device is located, said second pole forming a cathode, said voltage source having a third pole for generating a predeterminable electrical potential on the substrate, so that the charge carriers are applicable thereat by corresponding triggering of said control device, said third pole having a potential which is positive compared with the cathode potential, and said control device being assigned to at least one of said first and said second poles and being located at approximately 0-volt potential.

8. Marking device according to claim 7, wherein said charge carrier source is an ion source.

9. Marking device according to claim 7, wherein said first pole forms an anode.

10. Marking device according to claim 9, wherein said anode has a potential of >+200 V.

11. Marking device according to claim 7, wherein said cathode has a potential of approximately 0 V.

12. Marking device for controlled application of charge carriers to a substrate, comprising:

a charge carrier source for generating the charge carriers, a voltage source having a first pole and a second pole connected to said charge carrier source and forming therewith a current circuit wherein a control device is located, said second pole forming a cathode, said voltage source having a third pole for generating a predeterminable electrical potential on the substrate, so that the charge carriers are applicable thereat by corresponding triggering of said control device, and said control device located between said cathode and at approximately 0-volt potential.

13. Marking device according to claim 12, wherein said charge carrier source is an ion source.

14. Marking device according to claim 12, wherein said first pole forms an anode.

15. Marking device according to claim 14, wherein said anode has a potential of >+200 V.

16. Marking device according to claim 12, wherein said cathode has a potential of approximately 0 V.

17. Marking device for controlled application of charge carriers to a substrate, comprising:

a charge carrier source for generating the charge carriers, a voltage source having a first pole and a second pole connected to said charge carrier source and forming therewith a current circuit wherein a control device is located, said first pole forms an anode, said anode has a voltage U bringable to a voltage Umax for igniting said charge carrier source, said voltage Umax greater than a voltage Upeak at said anode, said anode having a standby or static state mode at an assumed voltage Ustat which is lower than said voltage Upeak, said voltage source having a third pole for generating a predeterminable electrical potential on the substrate, so that the charge carriers are applicable thereat by corresponding triggering of said control device, and said control device being assigned to at least one of said first and said second poles and being located at approximately 0-volt potential.

* * * * *